US006303201B1

(12) United States Patent
Baierl et al.

(10) Patent No.: US 6,303,201 B1
(45) **Date of Patent: *Oct. 16, 2001**

(54) BAG TAG AND NOVEL LAMINATE FOR MAKING SAME

(76) Inventors: Mark F. Baierl, 404 Armi Cir., Painesville, OH (US) 44077; David L. Edmonson, 105 E. 201st St., Euclid, OH (US) 44123; Karen Kinney, 2613 Lambda La., Flower Mound, TX (US) 75028; J. Edward Link, 7216 S. Downing Pl., Painesville, OH (US) 44077; Leila Vidmar, 4660 River St., Willoughby, OH (US) 44094; Dennis Francis, Data Documents, Inc., 3404 Dan Morton Dr., Dallas, TX (US) 75236

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/710,248

(22) Filed: Sep. 13, 1996

(51) Int. Cl.[7] ..... G09F 3/00

(52) U.S. Cl. ..... 428/40.1; 40/6; 40/27; 40/299; 40/662; 40/665; 283/80; 428/41.7; 428/41.8; 428/42.1; 428/42.2; 428/42.3; 428/43

(58) Field of Search ..... 428/40.1, 41.7, 428/41.8, 42.1, 42.2, 42.3, 43, 105; 283/80; 40/6, 665, 27, 299, 662

(56) References Cited

U.S. PATENT DOCUMENTS 4,916,841 * 4/1990 Dawson ..... 40/665
5,366,249 * 11/1994 Diemart ..... 428/42.3

OTHER PUBLICATIONS

U.S. application No. 08/713,410, filed Sep. 13, 1996 (copy not included).

* cited by examiner

*Primary Examiner*—Nasser Ahmad
(74) *Attorney, Agent, or Firm*—Renner, Otto, Boisselle & Sklar

(57) ABSTRACT

A novel bag tag comprises an elongated strip of material formed from a facestock and heavily bonded to a tear resistant liner. Some, but not all of the liner is removable on our end of the strip so that the two ends of the strip can be adhesively joined together for attaching the tag to a piece of luggage. The non-removable portion of liner remains in place to prevent tearing of the tag on the end bearing the adhesive layer.

31 Claims, 4 Drawing Sheets

BAG TAG AND NOVEL LAMINATE FOR MAKING SAME

BACKGROUND OF THE INVENTION

The present invention relates to a novel tag useful for tagging luggage and in other tagging applications.

In order to ensure that passenger luggage reaches its proper destination, the airline industry typically affixes a "bag tag" to each piece of checked luggage. A standard bag tag takes the form of a flat, elongated (e.g. 2" by 19") strip of material which is marked with the intended destination of the luggage. Normally, the tag is attached to the luggage by inserting one end of the strip through the luggage handle and then securing the two ends of the tag together by means of a pressure sensitive adhesive. To prevent the adhesive from bonding prematurely, a liner is provided as a covering for the adhesive layer. When the tag is to be used, a portion of the liner is peeled off the remainder of the tag, thereby exposing the adhesive. Usually, the liner is printed with a code or other indicia such that the liner also serves as a claim check for reclaiming the checked luggage.

FIGS. 1 to 3 herein illustrate the structure of a typical bag tag in use today. As shown in FIG. 1, laminate 20 from which the bag tag is made is composed of flexible paper or plastic liner 22, paper facestock 24 and reinforcing layer 26 therebetween. One side of reinforcing layer 26 is adhesively bonded to facestock 24 by means of adhesive layer 28, while the other side of reinforcing layer 26 is adhesively bonded to liner 22 by means of adhesive layer 32. Release layer 34 is provided between liner 22 and adhesive layer 32 to allow liner 22 to be peeled off of reinforcing layer 26, thereby exposing the adhesive of adhesive layer 32.

FIG. 2 illustrates the backside (i.e. the liner side) of a bag tag made from the laminate of FIG. 1. As shown in this figure, bag tag 36 is composed of body section 38, projecting section 40 and attachment section 42. Liner 22 of the laminate is subdivided by cut 43 so that the portion 44 of liner 22 in attachment section 42 is removable, thereby exposing the adhesive of adhesive layer 32. Unique indicia 46, which matches the same indicia on the reverse side of the tag (not shown), is provided so that removable liner portion 44 also serves as a claim check. The reverse side of tag 36 in projecting section 40 is also provided with indicia (not shown) identifying the intended destination of the bag. In modern bag tags, this indicia is usually thermally printed on the tag at the check in or baggage counter when the customer checks his luggage.

FIG. 3 illustrates the bag tag of FIG. 2 when attached to a bag or other piece of luggage. FIG. 3 is a cross sectional view similar to FIG. 1 and shows the tag of FIG. 2 secured to the handle 48 of a piece of luggage. To secure bag tag 36 in place, one end of the bag tag, either before or after removal of removable liner portion 44, is inserted through the handle of the luggage piece. Then, the two ends of the tag are brought together, after removable liner portion 44 has been peeled off, and compressed by hand. This causes projecting section 40 and attachment section 42 of the tag to adhesively bond together thereby forming conjoined web 50, with body section 38 of the tag forming a closed loop around handle 48 of the luggage piece for securely attaching tag 36 in place.

Bag tags made from elongated strips of material are often subjected to significant physical abuse in normal use conditions. As a result, they are prone to tear, particularly in a tearing zone 52 located as shown in FIG. 3 in the portion of attachment section 42 proximate body section 38 of the tag.

In particular, tag 36 tends to tear in a tearing zone 52 which is defined by the portion of attachment section 42 where liner 22 has been removed and which extends between the end 43 of liner 22 and the point 45 where reinforcing layer 26 of attachment section 42 bonds to liner 22 of projecting section 40.

In order to prevent bag tags from tearing, particularly in the tearing zones, it is customary to make reinforcing layer 26 from a tear resistant material arranged to extend along the entire length of the tag. For example, in one conventional bag tag of the type illustrated in FIGS. 1 to 3, reinforcing layer 26 of the tag (FIG. 1) is made from a material known as Valeron®. This material is composed of a laminate of two mono-axially oriented polypropylene layers bonded together such that the directions of orientation of the co-laminated layers are arranged approximately 90° with respect to one another. In another conventional bag tag of this type, reinforcing layer 26 is made from Tyvek® which is a spunbond polyethylene available from DuPont. Valeron® and Tyvek® exhibit a high degree of tear resistance in all directions. Accordingly, bag tags having the structure illustrated in FIGS. 1 and 2, when made with a Valeron® or Tyvek® reinforcing layer 26, exhibit a high degree of tear resistance since they include at least one reinforcing layer along their entire lengths.

Although conventional bag tags such as illustrated in FIGS. 1 to 3 perform adequately, especially when made from tear resistant materials, they are relatively complicated in structure and hence relatively expensive to manufacture. Accordingly, it would be desirable to provide a bag tag exhibiting comparable performance properties particularly in terms of tear resistance but which is simpler in construction and hence less expensive to manufacture and use.

SUMMARY OF THE INVENTION

In accordance with the present invention, tear resistance is imparted to a tag of the general type described above by forming the liner of the tag from a tear resistant material. As a result, the reinforcing layer, layer 26 in the prior art tag of FIGS. 1 to 3, can be totally eliminated. Thus, the inventive tag can be formed from a laminate having only two main layers—liner and facestock—rather than three main layers—liner, main body and facestock—as in the case of prior art tags.

To adhesively attach the two ends of the inventive tag together, the liner in the attachment portion of the inventive tag is removable to expose the underlying adhesive, in a manner similar to prior art tags. However, in the inventive tag, only a portion of this liner is removable. Another portion of this liner is intended to remain in place after the adhesive is exposed, this additional liner section serving to reinforce the attachment section of the tag in its tearing zone once the two ends of the tag are joined together. Accordingly, even though the inventive tag is made from only two primary layers rather than three as in prior art tags, it nonetheless exhibits excellent tear strength along essentially its entire length.

BRIEF DESCRIPTION OF THE DRAWINGS

The present invention may be more readily understood by reference to the following drawings wherein.

DETAILED DESCRIPTION

Figure 4:
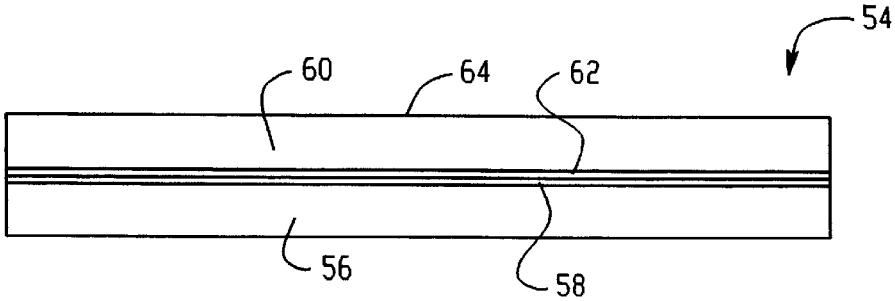
FIG. 4 is a schematic illustration of a laminate in accordance with the present invention used to form a bag tag of the present invention.

A flexible laminate in accordance with the present invention useful for forming the inventive tags is generally illustrated at 54 at FIG. 4. Laminate 54 is composed of liner 56 having a release surface composed of a layer 58 of release material and a facestock layer or web 60 bonded to liner 56 by means of adhesive layer 62 in contact with release layer 58.

Facestock 60 is preferably composed of paper, but can be composed of plastic or any other material which will allow tag 54 to function as described below. Moreover, it may be formed from a single layer of material or from multiple layers of paper or other materials.

Facestock 60 defines surface 64 which is writable by any conventional means such as by ink printing, laser printing or thermal printing. Preferably, surface 64 is provided with a thermally sensitive coating to make surface 64 thermally printable in a conventional manner. Surface 64 may also be provided with an environmentally resistant clear topcoat in a conventional manner.

Adhesive layer 62, which bonds facestock 60 to laminate liner 56, can be made from any conventional pressure sensitive adhesive. Preferably, it is made from a pressure sensitive adhesive having a minimum application temperature of +25° F. or less and a minimum service temperature of −65° F. or less. More preferably, it is made from a pressure sensitive adhesive having a minimum application temperature of −10° F. or less and a minimum service temperature of −65° F. or less. In this context, minimum application temperature refers to the minimum temperature at which the adhesive will adhesively bond to another surface. Minimum service temperature, in turn, refers to the lowest temperature at which the adhesive, previously bonded to a surface, will stay bonded thereto without becoming unbonded due to the cold. Such pressure sensitive adhesives are well known. Examples of such adhesives are acrylic emulsions, acrylic hot melts, solvent based acrylics and rubber-based adhesives.

Release layer 58, which directly bonds liner 56 to adhesive layer 62, can be made from any material which allows liner 56, or at least selected portions of liner 56 as described below, to be removed by hand. Such materials are well known in the art. Preferably, release layer 58 exhibits a release force of about 35 to about 250 grams per 2 inches, more preferably about 50 to 150 grams per 2 inches. In those instances in which laminate liner 56 is formed from a thermally sensitive material (e.g. a monoaxially-oriented polymer), release layer 58 is preferably made from a material which does not require a thermal cure to complete its application. Examples of such material are room temperature curable, moisture curable, radiation (e.g. UV and electron beam) curable polydimethylsiloxanes containing high release agents. Such materials are also well known.

Laminate liner 56 is formed from a material exhibiting a high tear resistance. Preferably, this material has a tear resistance such that laminate 54 as a whole has a tear resistance of at least 1 Newton, more preferably at least 4 Newtons. Most preferable laminates are formed from laminate liners having a tear resistance of at least 10 Newtons. Examples of such materials are polyesters, nylons and polyolefins such as polyethylene and polypropylene. A preferred material for forming liner 56 is the spunbond polyethylene product known as Tyvek®. In a particulalry preferred embodiment of the invention, laminate liner 56 is formed from the material known as Valeron®, which as indicated above, is a laminate of two uniaxially-oriented polypropylene layers.

FIGS. 5 to 8 and 12 to 14 illustrate various different tags made in accordance with the present invention. Each of these tags, generally indicated at 66, is composed of an elongated strip of material formed from the laminate of FIG. 4. Each of these tags includes a body portion 68, a projecting section 70 on one side of the body section and an attachment section 72 on another side of body section 68. As in the case of the prior art tag, each of the inventive tags defines a tearing zone 52 in its attachment section where the tag is weakened due to the removal of the liner layer for exposing the underlying adhesive.

In accordance with the present invention, the portion of laminate liner 56 which is present in attachment section 72 of each tag 66 is subdivided into a removable portion 76 and a non-removable section 78. In this context, "non-removable" means only that this portion of the liner is not intended to be removed from the tag. Since release layer 58 separates liner 56 from adhesive layer 62 across the entire cross sectional area of the tag, the entire liner is physically removable from the facestock layer, if desired. "Non-removable" refers only to the fact that this section of the liner is intended not to be removed when the tag is used in a normal fashion.

Figure 5:
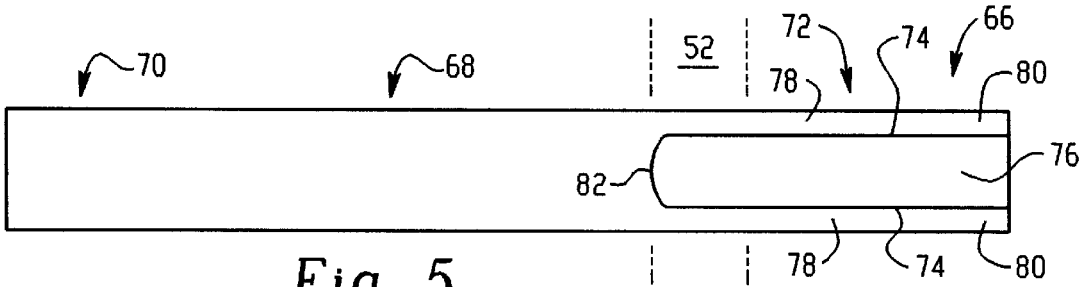
FIGS. 5, 6, 7, 8, 12, 13 and 14 are plan views illustrating the backside (liner side) of specific bag tags made in accordance with the present invention.
Figure 6:
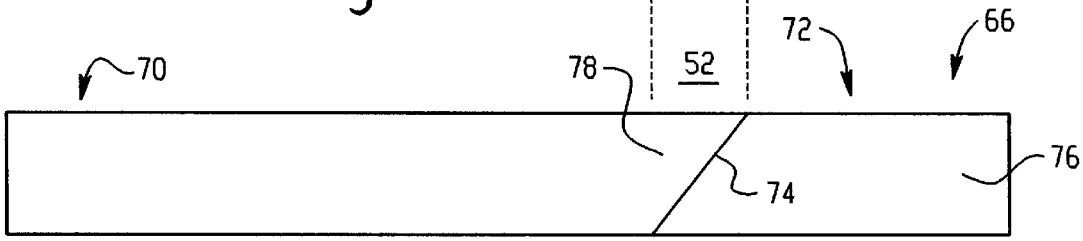
Figure 7:
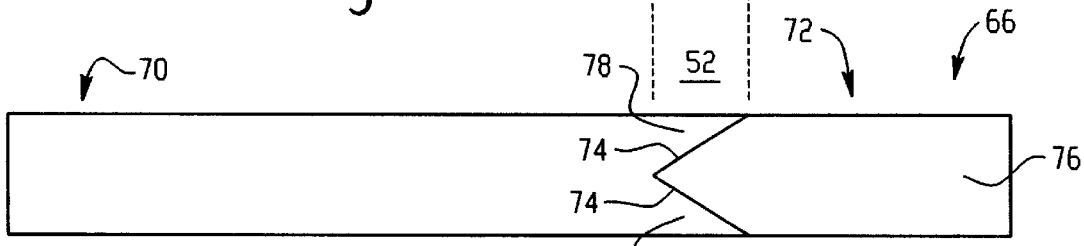
Figure 9:
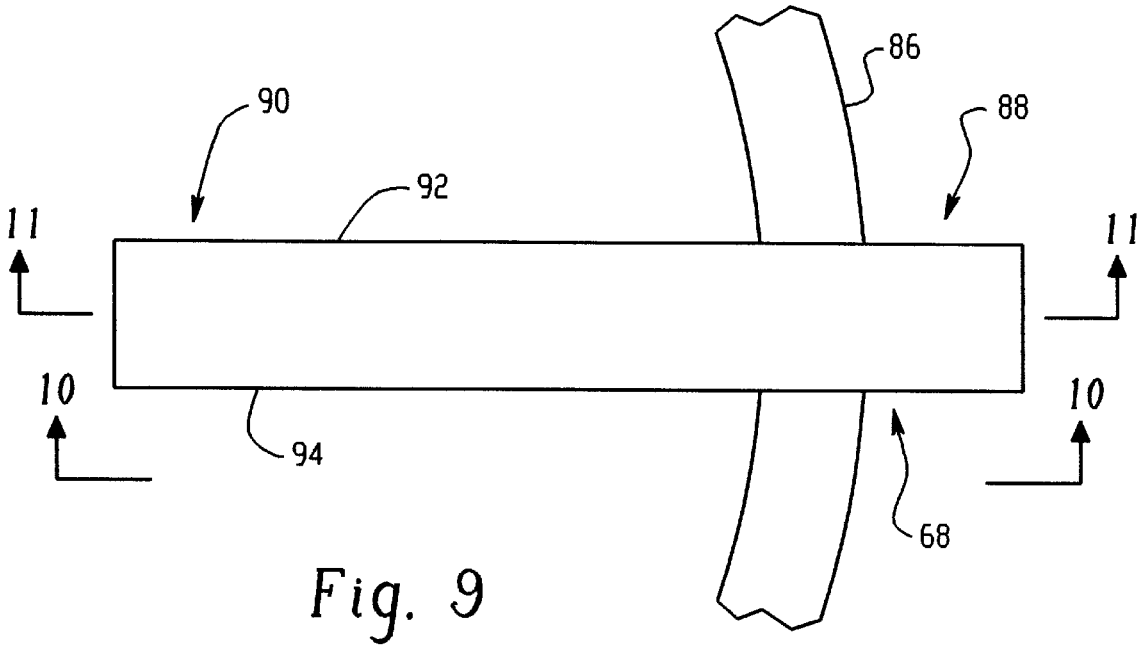
FIG. 9 is a schematic plan view illustrating the bag tag of FIG. 5 of the present invention when secured to the handle of a piece of luggage.
Figure 10:
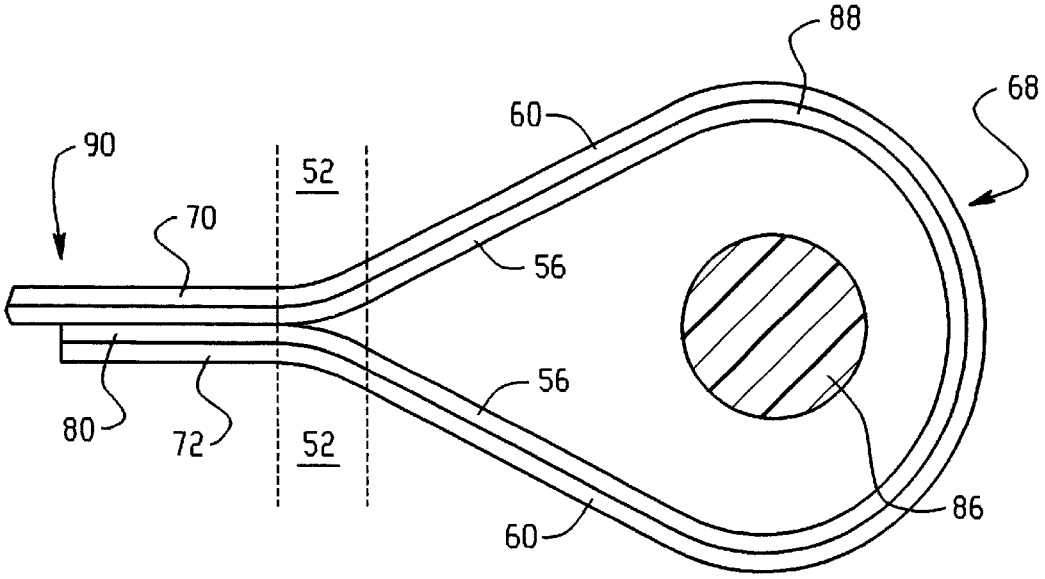
FIG. 10 is a schematic side view taken on line 10—10 of FIG. 9.
Figure 11:
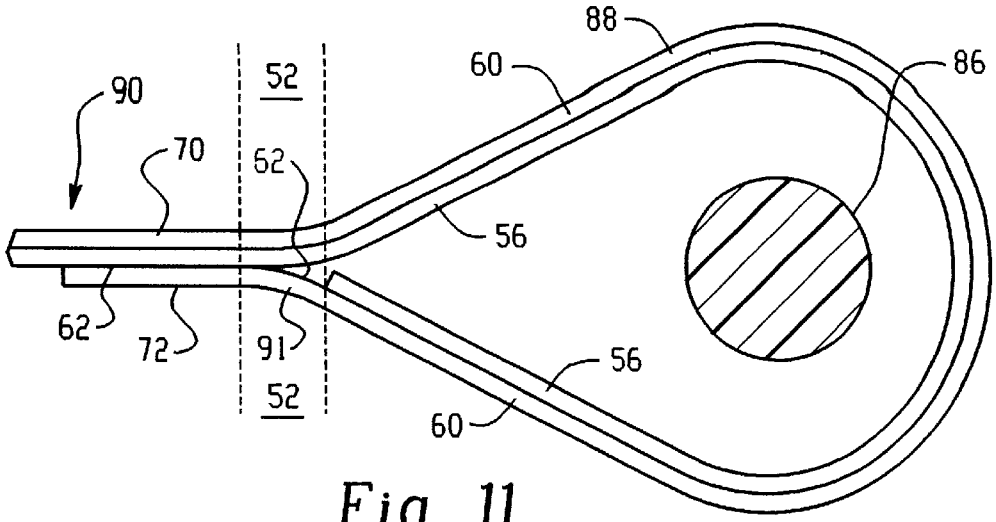
FIG. 11 is a schematic side view taken on line 11—11 of FIG. 9.

FIGS. 9, 10 and 11, which show the inventive bag tag of FIG. 5 attached to the handle 86 of a piece of luggage, illustrate the advantageous results achieved through subdividing liner 56 into removable and non-removable portions 76 and 78, respectively. As shown in these figures, when the two ends of the tag are secured together they form conjoined web 90 with body portion 68 of the tag forming a closed loop 88 for securing the tag to the handle 86 of the luggage. Viewing the tag when secured in this manner along its longitudinal centerline (FIG. 11), it can be seen that adhesive layer 62 bonds attachment section 72 to projecting section 70 of the tag. At this central location, in tearing zone 52, there is a section 91 of the tag which is relatively weak in terms of tear resistance. This is because the tag at this location comprises only facestock layer 60 and adhesive layer 62, neither of which has any significant tear resistance. It will therefore be appreciated that if tag 66 were uniform across its entire width in terms of structure, as is the case with prior art tags, then tag 66 would be prone to tearing in zone 52. This is because there would be nothing in this area to stop a tear initiated in this zone from extending transversely all the way across the tag from one edge to the other.

In accordance with the present invention, however, tearing of tag 66 in tearing zone 52 is essentially prevented by the portions of liner layer 56 which have been left in place when removable section 76 is removed, i.e. by non-removable portion 78 of the liner. This is more clearly shown in FIGS. 5 and 10.

As shown in FIG. 5, U-shaped cut 74 separates the portion of laminate liner 56 in attachment section 72 of tag 66 into a removable portion 76 and non-removable portion 78. Non-removable portion 78, also being U-shaped, defines arms 80 arranged along the borders of the tag and a base 82 arranged proximate body portion 68 of the tag. Referring to FIG. 10, (side view taken on line 10—10 of FIG. 9) arms 80 remain in place adjacent the lateral edges of the tag in tearing zone 52 when the ends of the tag are bonded together to form conjoined web 90. Since arms 80 are themselves tear resistant, stresses imparted to the tag in tearing zone 52 are effectively prevented from initiating and/or propagating a tear in this zone, even though liner 56 in the central section of the zone has already been removed. As a result, the inventive tag exhibits excellent tear resistance throughout its entire length, including tearing zone 52, even though it is formed from only two main layers rather than three as in the case of the prior art products.

Figure 1:
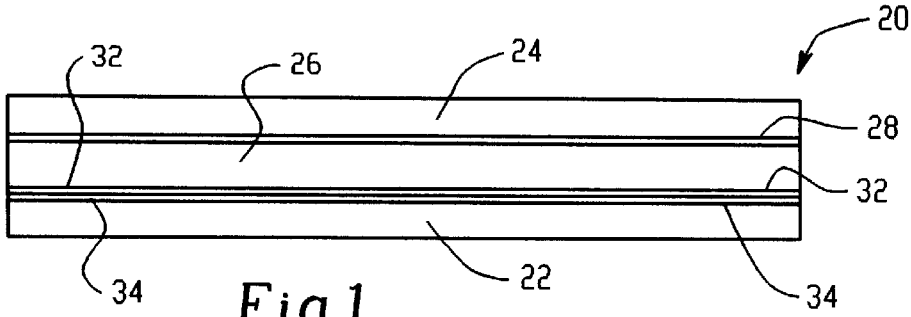
Fig.1 (PRIOR ART)
FIG. 1 is a schematic side view of laminates used to make prior art bag tags of the type to which the present invention is directed.
Figure 2:
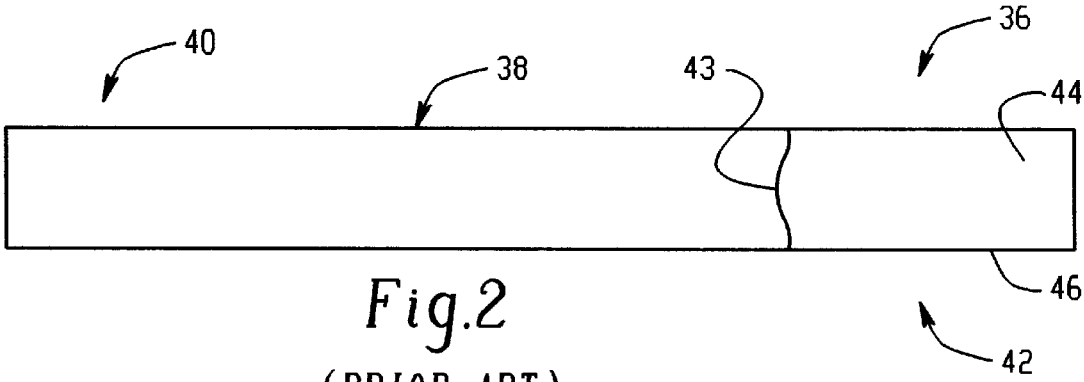
Fig.2 (PRIOR ART)
FIG. 2 is a schematic representation of a prior art bag tag made from the laminate of FIG. 1.
Figure 3:
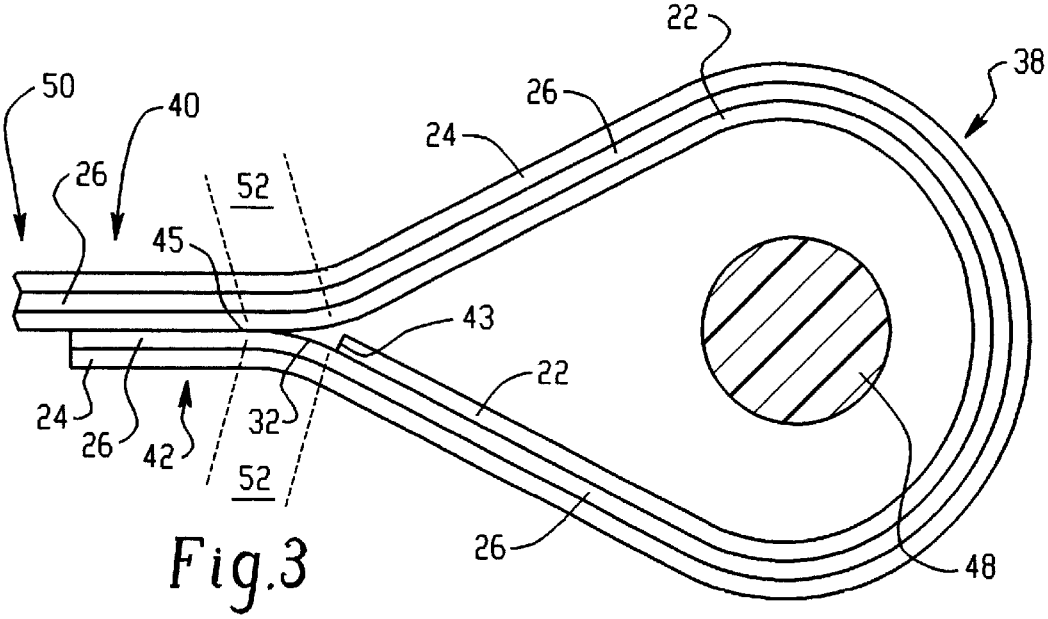
Fig.3 (PRIOR ART)
FIG. 3 is a schematic cross sectional view illustrating the prior art bag tag of FIG. 2 when attached to a piece of luggage.

This advantage of the present invention may be more readily understood by again referring to the prior art tags as illustrated in FIGS. 1 to 3. Tearing of these tags is prevented by including in the prior art tag a reinforcing layer 26. Protecting the adhesive, however, is accomplished by a wholly separate layer, the liner. Thus, the prior art tag must be formed from three separate, primary layers—the liner, the reinforcing layer and the facestock. This, in turn, requires that two separate laminating steps be used to produce the prior art tag, one for bonding the reinforcing layer to the facestock and the other for bonding the reinforcing layer to the liner.

In accordance with the present invention, however, non-removable portion 78 of laminate liner 56 is relied upon to provide the necessary tear resistance in tearing zone 52. Accordingly, the inventive tag need be formed from only two primary layers, the liner and the facestock. This, in turn, means that only a single laminating step is needed to manufacture the inventive tag, i.e. laminating the liner to the facestock. It will therefore be appreciated that the inventive tag is simpler in construction, and much easier to manufacture, than tags of a conventional design. Moreover, the inventive tag can be made thinner than its prior art counterparts meaning that more tags can be packed in a given shipping container than possible before. Also, because the tag liner is made from plastic rather than paper as in the case of many prior art tags, the "paper cuts" can be largely eliminated.

Figure 8:
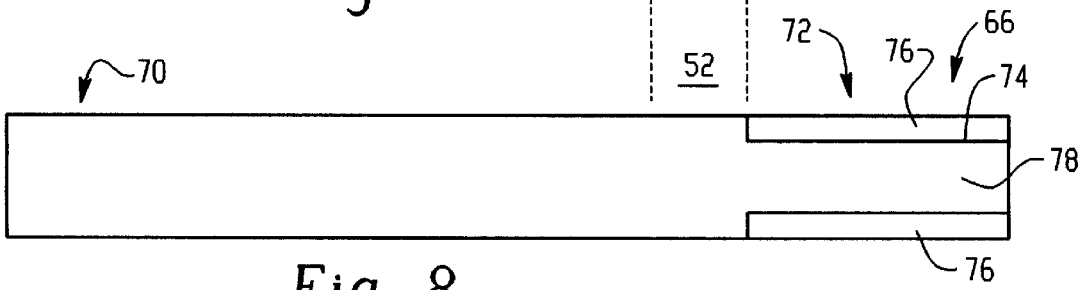
Figure 12:
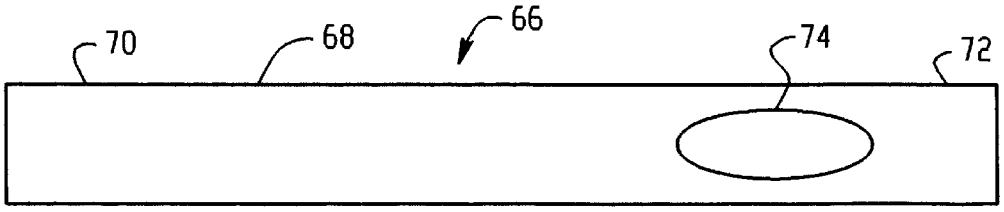
Figure 13:
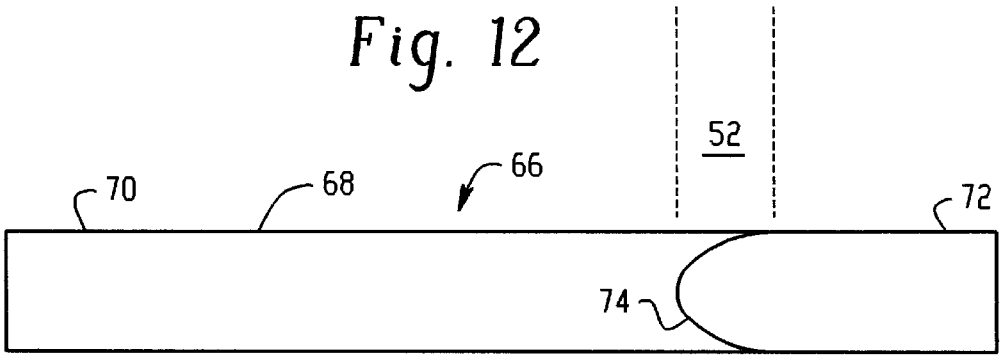
Figure 14:
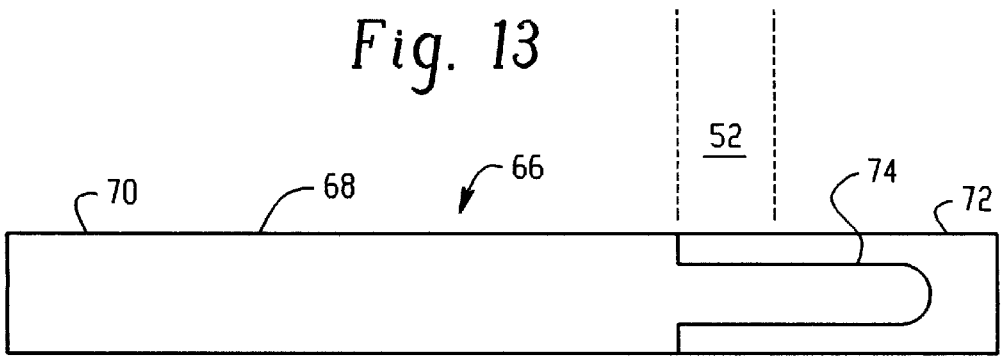

FIGS. 6 to 8 and 12 to 14 illustrate additional tag designs made in accordance with the present invention. Like the tag of FIG. 5, the tags 66 of FIGS. 6 to 8 and 12 to 14 are each composed of an elongated strip of material formed from the laminate of FIG. 4. In addition, each of these tags includes a body portion 68, a projecting section 70 on one side of the body section and an attachment section 72 on another side of body section 68. Also, each of these tags defines a tearing zone 52 in its attachment section where the tag is weakened due to the removal of the liner therefrom for exposing adhesive layer 62. In the inventive tags of FIGS. 6, 7, and 13 cut 74 and hence substantially all of the non-removable portion 78 of liner 56 is in this tearing zone. The tag of FIG. 8 is similar to that of FIG. 5, however, in that cut 74 and hence the non-removable portion 78 of liner 56 extends along the entire length of attachment section 72 of the tag. In the tags of FIGS. 12 and 14, cut 74 and hence non-removable portion 78, extends through the entire length of tearing zone 52 as well as through a portion but not all of the remainder of attachment section 72. In all of the tags of FIGS. 5 to 8, and 12 to 14, the non-removable portion 78 of liner 56 is attached to the liner in the remainder of the tag. Non-removable portion 78 of liner 56 may be separated from the liner in the remainder of the tag if desired, although this is not preferred.

The present invention is particularly suitable for use in making bag tags. For this purpose, laminate 54 of the present invention is subdivided into elongated strips of material which are typically rectangular in configuration and measure about 2 inches by 19 inches, hereinafter "tag blanks". Such tag blanks are then processed into tags, by cutting the liner of the tag blank to form the removable liner portion and adding suitable indicia. Other tag blank shapes and sizes are also possible. For example, such tag blanks may be as short as 6 inches and as long as 3 feet. They also may be as narrow as 1 inch, even 0.5 inch if desired, and as wide as 3 inches, even 4 inches. Basically, such tag blanks should be long enough and wide enough so that tags made therefrom easily wrap around luggage handles in the manner described above and, in addition, provide a protruding portion, i.e. projection section 70, large enough to receive indicia easily seen from a distance of about 2 meters.

Although only a few embodiments of the present invention have been described above, it should be appreciated that many modifications can be made without departing from the spirit and scope of the invention. For example, although the foregoing description has indicated that the tags produced in accordance with the present invention are useful for tagging luggage, it should be appreciated that these tags can be used in many other tagging applications as well. For example, the tags of the present invention are ideally suited for tagging jewelry, for use as lift tickets in ski resorts and for many other uses. All such modifications are intended to be included within the scope of the present invention, which is to be limited only by the following claims:

We claim:

1. A tag for use in tagging objects, said tag being formed from a laminate comprising a polymeric liner having a release surface and exhibiting a tear resistance of at least about 1 Newton meters per inch, a facestock web having a writable skin layer on one side thereof and an attachment face on an opposite side thereof, and a pressure sensitive adhesive bonding the attachment face of said facestock to the release surface of said liner, said tag defining a body section, a projecting section on one side of said body section for displaying written information when said tag is attached to said object and an attachment section on another side of said body section, said attaching section having an adhesive for bonding said attaching section to said projecting section, said projecting section and said attachment section together forming a conjoined web when bonded to one another, said body section forming a closed loop for attaching said tag blank to said object when said attachment section is bonded to said projecting section, the laminate liner in the attachment section of said tag blank being subdivided such that said laminate liner in said attaching section defines a removable portion and a non-removable portion, said removable portion being removable from said tag blank for exposing said adhesive for bonding said attaching section to said projecting section, said non-removable portion remains bonded to said facestock when said removable portion is removed from said tag blank whereby tearing of said conjoined web off of said tag blank is substantially prevented.

2. The tag of claim 1, wherein said attachment section defines a tearing zone proximate said body section, at least a part of said removable portion of laminate liner being in said tearing zone, and at least a part of said non-removable portion of laminate liner being in said tearing zone.

3. The tag of claim 2, wherein said tearing zone defines a longitudinal direction and a transverse direction, and further wherein the non-removable portion of laminate liner in said tearing zone longitudinally extends from the side of said tearing zone proximate said body section to the opposite side of said tearing zone, whereby tearing of said tag across the entire width of said tearing zone is substantially prevented.

4. The tag of claim 2, wherein substantially all of said non-removable portion of laminate liner is in said tearing zone.

5. The tag of claim 2, wherein a part of said non-removable portion of laminate liner is positioned adjacent all borders of said tag blank in said tearing zone whereby tearing of said conjoined web in said tearing zone is substantially prevented.

6. The tag of claim 5, wherein said non-removable portion is U-shaped, said U defining arms arranged along the borders of said tearing zone and a base arranged proximate said body portion.

7. The tag of claim 6, wherein said tag in said attachment section defines lateral borders, and further wherein a part of said non-removable portion of laminate liner is positioned adjacent substantially all of said lateral borders whereby tearing of said attaching section is substantially prevented along substantially its entire length.

8. The tag of claim 7, wherein said non-removable portion is U-shaped, said U defining arms arranged along the borders of said attaching section and a base arranged proximate said body portion.

9. The tag of claim 8, wherein said non-removable portion of laminate liner extends from the body portion of said tag blank to the end of said attaching section remote form said body portion.

10. The tag of claim 1, wherein said non-removable portion of laminate liner is attached to the laminate liner in the body section of said tag.

11. The tag of claim 1 further comprising written indicia on said facestock in the projecting section of said tag.

12. The tag of claim 1 wherein the polymeric liner is derived from polyesters, nylons, olefins or mixtures thereof.

13. The tag of claim 1 wherein the liner is derived from polyethylene, polypropylene or mixtures thereof.

14. A tag for use in tagging objects, said tag being formed from a laminate comprising a polyolefin liner having a release surface and exhibiting a tear resistance of at least about 1 Newton meters per inch, a facestock web having a writeable skin layer on one side thereof and an attachment face on an opposite side thereof, and a pressure sensitive adhesive bonding the attachment face of said facestock to the release surface of said liner, said tag defining a body section, a projecting section on one side of said body section for displaying written information when said tag is attached to said object and an attachment section on another side of said body section, said attaching section having an adhesive for bonding said attaching section to said projecting section, said projecting section and said attachment section together forming a conjoined web when bonded to one another, said body section forming a closed loop for attaching said tag blank to said object when said attachment section is bonded to said projecting section, the laminate liner in the attachment section of said tag blank being subdivided such that said laminate liner in said attaching section defines a removable portion and a non-removable portion, said removable portion being removable from said tag blank for exposing said adhesive for bonding said attaching section to said projecting section, said non-removable portion remains bonded to said facestock when said removable portion is removed from said tag blank whereby tearing of said conjoined web off of said tag blank is substantially prevented.

15. A flexible laminate useful for flexible, writeable materials, said laminate comprising only two main layers:

a first main layer comprising a polymeric liner having a release surface and exhibiting a tear resistance of at least about 1 Newton meter per inch;

a second main layer comprising a facestock web having a writeable skin layer on one side thereof and an attachment face on an opposite side thereof; and a pressure sensitive adhesive bonding the attachment face of said facestock to the release surface of said liner, wherein the polymeric liner has a removable and non-removable portion.

16. The laminate of claim 15, wherein said liner has a tear resistance of at least about 4 Newton meters per inch.

17. The laminate of claim 15, wherein the release surface of said polymeric liner comprises a layer of a release material.

18. The laminate of claim 15, wherein said liner is composed of first and second co-laminated layers, each of said co-laminated layers being mono-axially oriented in respective directions which are different from one another when said co-laminated layers are joined together for forming said liner.

19. The laminate of claim 18, wherein the directions of orientation of said co-laminated layers in said liner are arranged at an angle of approximately 90 degrees with respect to one another.

20. The laminate of claim 18, wherein said liner is composed of polyethylene, polypropylene, polyester or nylon.

21. The laminate of claim 20, wherein said liner is composed of polypropylene and wherein said facestock is composed of paper.

22. The laminate of claim 21, wherein said liner is composed of first and second co-laminated layers, each of said co-laminated layers being formed from polypropylene and being mono-axially oriented in respective directions which are arranged at an angle of approximately 90 degrees with respect to one another when said co-laminated layers are joined together for forming said liner.

23. The laminate of claim 15, wherein said pressure sensitive adhesive has a minimum application temperature of +25° F. or less.

24. The laminate of claim 23, wherein said pressure sensitive adhesive has a minimum application temperature of −10° F. or less.

25. A tag blank for use in making a bag tag, said tag blank comprising an elongated strip of the laminate of claim 15.

26. A flexible laminate useful for forming flexible, writeable materials, said laminate comprising only two main layers (a) a first main layer comprising a facestock web having a writeable surface skin layer on one side thereof and an attachment face on the side opposite said one side thereof, (b) a second main layer comprising a polymeric liner having a release surface and exhibiting a tear resistance of at least about 1 Newton meters per inch, and a pressure sensitive adhesive bonding the attachment face of said facestock to the release surface of said liner, wherein the liner is composed of a first and a second co-laminated layer, wherein each layer is oriented in directions which are different from one another.

27. The laminate of claim 26, wherein the polymeric liner is composed of polyethylene, polypropylene, polyester or nylon.

28. The laminate of claim 26, wherein the direction of orientation of said co-laminated layers in said liner are arranged at an angle of approximately 90 degrees with respect to one another.

29. The laminate of claim 26, wherein the facestock is paper.

30. A tag blank for use in making a bag tag, said tag blank comprising an elongated strip of the laminate of claim 26.

31. A flexible laminate used for forming flexible, writeable materials said laminate comprising only two main layers:

a first main layer comprising a polymeric lining having a release surface and exhibiting a tear resistance of at least 1 Newton meter per inch;

a second main layer comprising a facestock web having a writeable skin layer on one side thereof and an attachment face on an opposite side thereof; and a pressure sensitive adhesive bonding the attachment face of said facestock to the release surface of said liner, wherein the liner is composed of a first and second co-laminated layer, wherein each layer is oriented in directions which are different from one another.

* * * * *